United States Patent [19]

Friedman

[11] Patent Number: 4,772,450

[45] Date of Patent: Sep. 20, 1988

[54] METHODS OF FORMING POWDERED METAL ARTICLES

[75] Inventor: Gerald Friedman, Cleveland Heights, Ohio

[73] Assignee: TRW Inc., Cleveland, Ohio

[21] Appl. No.: 634,684

[22] Filed: Jul. 25, 1984

[51] Int. Cl.[4] ..... B22F 3/00

[52] U.S. Cl. ..... 419/49; 419/48; 419/68; 29/156.8 B

[58] Field of Search ..... 419/48, 49, 68; 29/156.8 B

[56] References Cited

U.S. PATENT DOCUMENTS

| | | | |
|---|---|---|---|
| 2,725,288 | 11/1955 | Dodds | 75/226 |
| 3,419,935 | 12/1966 | Pfeiler et al. | 75/226 |
| 3,700,435 | 10/1972 | Chandhok . | |
| 4,023,966 | 5/1977 | Loersch et al. | 419/49 |
| 4,065,303 | 12/1977 | Seilstorfer et al. | 75/226 |
| 4,329,175 | 5/1982 | Turner | 75/226 |
| 4,428,906 | 1/1984 | Rozmus | 419/49 |

FOREIGN PATENT DOCUMENTS

| | | | |
|---|---|---|---|
| 0090118 | 11/1982 | European Pat. Off. . | |
| 2631441 | 7/1976 | Fed. Rep. of Germany . | |
| 2724524 | 12/1977 | Fed. Rep. of Germany . | |
| 3049424 | 7/1982 | Fed. Rep. of Germany | 419/49 |
| 1445993 | 6/1966 | France . | |
| 2272777 | 12/1975 | France . | |
| 2322731 | 4/1977 | France . | |
| 2376713 | 8/1978 | France . | |
| 1071591 | 6/1967 | United Kingdom . | |

OTHER PUBLICATIONS

Powder Metallurgy of Titanium Alloys, edited by F. H. Froes and J. E. Smugeresky.

Metal Handbook, 9th Ed., vol. 7.

Titanium Net Shape Technologies, edited by Froes and Eylon.

SAMPE Quarterly, Apr., 1981.

*Primary Examiner*—Allan M. Lieberman

*Attorney, Agent, or Firm*—Tarolli, Sundheim & Covell

[57] ABSTRACT

In forming an article, such as a turbine blade, of metal powder, a container is first formed by electroplating a thin layer of metal over a pattern having a configuration which corresponds to the configuration of the article. The pattern is then removed to leave a container having a cavity with a configuration corresponding to the configuration of the article. The container is filled with metal powder and sealed. The container is then at least partially enclosed with a rigid body of fluid permeable material having inner side surface areas disposed in abutting engagement with the container. Heat and fluid pressure are transmitted through the rigid body to compact the container and metal powder. The fluid pressure causes the side walls of the container to move away from the inner side surfaces of the rigid body of fluid permeable material. As this is occurring, the rigid body of fluid permeable material supports the container and holds it against excessive deflection under the influence of stresses induced in the container.

84 Claims, 3 Drawing Sheets

METHODS OF FORMING POWDERED METAL ARTICLES

BACKGROUND OF THE PRESENT INVENTION

The present invention relates to a method of forming an article from metal powder by heating and applying fluid pressure against a container of the metal powder.

It has previously been suggested that articles, such as a turbine blade, could be formed of metal powder. When this is to be done, a container having a cavity with a configuration which corresponds to the configuration of the turbine blade is filled with metal powder. The container is then sealed and subjected to hot isostatic pressing in the manner disclosed in U.S. Pat. No. 4,329,175.

It has been suggested, in U.S. Pat. Nos. 4,065,303 and 4,023,966, that a container for a hot isostatic pressing process could be formed by electroplating over a wax pattern. The wax pattern is then removed from the electroplated layer of metal. This results in a container having a cavity with a configuration corresponding to the configuration of the pattern and the article to be formed from metal powder. The container must be thick enough to have sufficient structural strength to be self-supporting during filling of the container with metal powder and during the subsequent compaction of the metal powder at relatively high temperatures and pressures.

Another approach to the forming of a mold for hot isostatic pressing is disclosed in European Patent Application Publication No. 0 090 118. This publication discloses a process wherein a wax pattern is repetitively dipped in a refractory slurry. The layers of refractory material on the pattern are hardened and the wax is removed to leave a mold having an inner surface with a desired configuration. The inner surface of the mold is coated with metal by a chemical vapor deposition process. The mold is then filled with metal powder.

The mold is then "processed in the normal manner" to produce a powder metallurgy part. It is believed this included sealing the mold in a fluid tight container with the mold surrounded by a granular material. Is believed that the fluid tight container is then exposed to fluid pressure to compact the metal powder in the container. During this compaction, it is believed that fluid pressure is applied against the exterior of the container to force it inwardly against the granular material which in turn transmits pressure to the ceramic mold. The force applied against the ceramic mold is transmitted to the metal powder.

BRIEF SUMMARY OF THE PRESENT INVENTION

The present invention provides a new and improved method of forming an article, such as a turbine blade or vane from metal powder. In practicing the method, a thin metal container having an interior cavity with a configuration corresponding to the configuration of the article is formed. The container is filled with metal powder and sealed. Thereafter, the container is at least partially enclosed within a rigid body of fluid permeable material. The rigid body has inner side surface areas which are disposed in abutting engagement with outer side surface areas of the container.

The container and the metal powder in the container are then heated and the container is subjected to fluid pressure. The fluid pressure is transmitted through pores in the rigid body and is applied against the outer side surfaces of the container to compact the container and heated metal powder. As the container and metal powder are compacted, the side walls of the container move away from inner side surface areas of the rigid body of fluid permeable material.

During the compacting of the metal powder, unbalanced stresses are induced in the relatively thin side walls of the container. These stresses tend to cause excessive deflection and distortion of the container. However, deflection of the container is blocked by the rigid body of fluid permeable material. In addition to preventing excessive deflection of the container under the influence of the stresses which are induced during compaction of the metal powder, the rigid body of fluid permeable material supports the container. This prevents excessive sagging of the thin metal of the container after it has been heated to temperatures necessary to obtain diffusion bonding of the metal powder.

The rigid body of fluid permeable material can be formed around the container in many different ways. Specifically, a rigid body of ceramic material may be molded around the sealed container or may be formed around the sealed container by repetitively dipping the container in a slurry of ceramic material. However, it may be preferable to enclose the sealed container with a pair of rigid ceramic blocks having preformed surfaces for engaging the container. Although the blocks may initially be placed in flat abutting engagement with each other, it may be preferred to leave a gap between that portion of the blocks outward of the powder filled container and to close this gap as the container of metal powder is compacted.

When the container is enclosed by rigid ceramic blocks, the blocks are held against separation under the influence of force applied against the blocks by the container. The blocks may be held against separating movement by using weights, temperature compensated clamps or a fluid spring.

Accordingly, it is an object of this invention to provide a new and improved method of forming an article from metal powder and wherein a container of metal powder is enclosed with a rigid body of fluid permeable material and is held against excessive distortion during compacting of the metal powder by the rigid body of fluid permeable material.

Another object of this invention is to provide a new and improved method of forming an article from metal powder and wherein a thin metal container of metal powder is enclosed with a rigid body of fluid permeable material and is supported during compacting of the metal powder by the rigid body of fluid permeable material.

Another object of this invention is to provide a new and improved method of forming an article from metal powder and wherein a container of metal powder is enclosed by blocks of rigid fluid permeable material which support the container during the compacting of the metal powder under the influence of fluid pressure transmitted through the blocks.

Another object of this invention is to provide a new and improved method as set forth in the next preceding object and wherein the blocks are held against separation during compaction of the metal powder.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
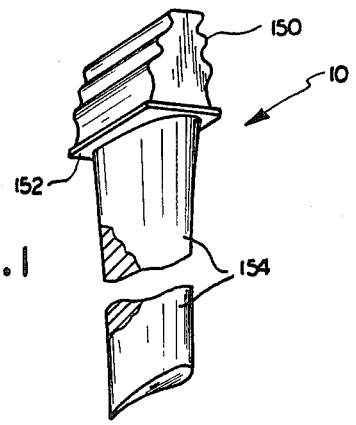
FIG. 1 is a partially broken away sectional view of a turbine blade or vane formed from metal powder.
Figure 2:
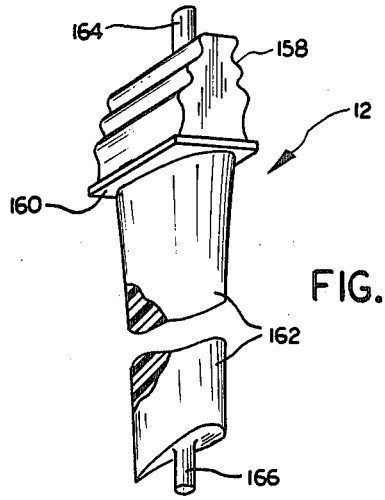
FIG. 2 is a partially broken away view of a pattern having a configuration corresponding to the configuration of the turbine blade of FIG. 1.

The present invention provides a method of accurately and inexpensively forming articles having a relatively complicated configuration from metal powder by a hot isostatic pressing process. Thus, a turbine blade or vane 10 (see FIG. 1) is formed from metal powder by the method of the present invention. However, it is contemplated that the method will be used to form articles having many different configurations. The method is particularly well adapted to the formation of elongated, nonaxis-symmetric articles which tend to distort during a hot isotatic pressing process.

Figure 3:
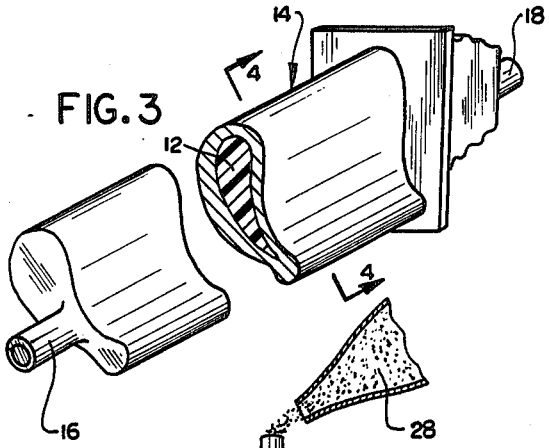
FIG. 3 is a partially broken away view of the pattern of FIG. 2 after it has been electroplated with a thin metal covering.

To form the elongated turbine blade 10, a wax or plastic pattern 12 having a configuration corresponding to and slightly larger than the configuration of the turbine blade, is made in a master die. The wax pattern 12 is electroplated with a thin continuous layer 14 (see FIG. 3) of metal. Openings are then formed in the ends of projections 16 and 18 at tip and root ends of the metal layer 14.

Figure 4:
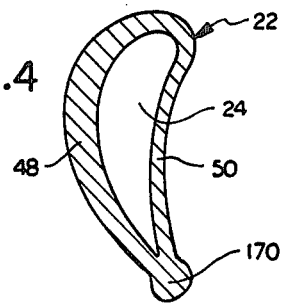
FIG. 4 is a sectional view, taken generally along the line 4—4 of FIG. 3, illustrating the configuration of a cavity in a container formed by removing the pattern from the thin covering of electroplated metal.

The metal layer 14 is heated to melt the pattern 12. The melted wax or plastic material of the pattern flows from within the layer 14 of metal through the opening formed in a cylindrical projection 16 at the tip end. A flow of hot solvent is then conducted from the root end projection 18 through the thin metal shell and out of the tip end projection 16 to dissolve any remaining wax. This results in the formation of an elongated container 22 (FIG. 4) having a cavity 24 with a configuration corresponding to the configuration of pattern 12 and the airfoil 10.

Figure 5:
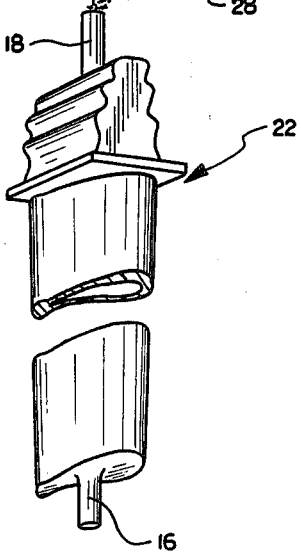
FIG. 5 is a schematic illustration depicting the filling of the cavity in the container of FIG. 4 with metal powder.

The tip end projection 16 is then sealed and metal powder 28 (see FIG. 5) is poured into the container 22 through the opening in the root end projection 18. Once the container 22 has been filled with metal powder in the manner illustrated schematically in FIG. 5, the opening in the root end projection 18 is also sealed.

Figure 6:
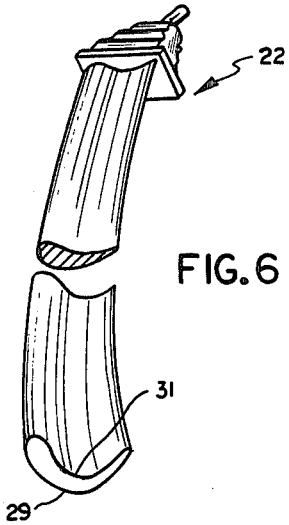
FIG. 6 is a schematic illustration of the container of FIG. 5 after it has been compacted without enclosing the container within a rigid body of fluid permeable material.

To form the turbine blade 10, the metal powder 28 is compacted and diffusion bonded by a hot isostatic pressing process. Since the container 22 is formed of a relatively thin layer of metal, if the filled and sealed container is subjected to hot isostatic pressing without providing a support for the container, the container distorts excessively during the hot isostatic pressing process, in the manner shown schematically in FIG. 6.

The deformation of the container 22 (FIG. 6) during the hot isostatic pressing process results in excessive bowing of the container and curling of the container at its edge portions so that the container has a configuration which resembles the configuration of a banana. Although the cause of this distortion is not precisely known, it is believed that it is due to many factors including sagging of the thin metal of the container at the elevated temperatures at which hot isostatic pressing occurs and to stresses set up in the walls of the container. These stresses may be due, in part at least, to the asymmetric shape of the container walls. Thus, a convex side 29 (FIG. 6) of the airfoil-shaped container has a greater length than a concave side 31. In addition, the stresses may be partially caused by variations in the thickness of the layer 14 of metal deposited on the pattern 12 during the electroplating process.

In accordance with a feature of the present invention, distortion of the elongated container 22 during hot isostatic pressing of the container is avoided by at least partially enclosing the filled and sealed container in a rigid body of fluid permeable material. The rigid body of fluid permeable material transmits heat and fluid pressure to the container 22 and the metal powder 28 while supporting the container and preventing excessive deformation or distortion of the container.

In one specific instance, the rigid body of fluid permeable material is formed by molding a rigid block 32 (see FIG. 8) of ceramic material around the container 22. This is done by positioning the filled and sealed container 22 in a mold 34 (see FIG. 7) and at least partially filling the mold with a slurry 36 of ceramic material. The slurry 36 of ceramic material is hardened to form the rigid and fluid permeable block 32.

Figure 9:
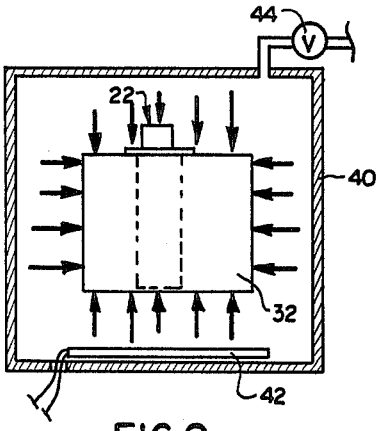
FIG. 9 is a schematic illustration depicting the container and body of material of FIG. 8 in a autoclave or hot isostatic pressing unit in which the container and metal powder are compacted under the influence of fluid pressure transmitted through the rigid body of ceramic material.

The sealed container 22 of metal powder and the rigid block 32 are then placed in a hot gas autoclave, that is, a hot isostatic pressing unit 40 (FIG. 9). Heat from a resistance heater 42 is transmitted through the block 32 to the container 22 and metal powder 28 within the container 22. The metal powder is heated to a temperature sufficient to cause diffusion bonding of the particles of metal powder in the container. Contemporaneously therewith, a valve 44 is opened so that a high pressure inert gas, such as argon, is conducted to the interior of the autoclave 40 and surrounds the rigid block 32. The fluid pressure of the argon gas is transmitted through the block 32 of fluid permeable ceramic material and is applied against the outer surfaces of side walls 48 and 50 of the container 22 in the manner illustrated schematically in FIG. 10.

The autoclave 40 may have many different constructions, such as the construction described in the publication entitled "Hot Isostatic Processing" by H. D. Hanes in the book *Hi-Pressure Science and Technology*, Vol. 2, 1979, published by Plenum Publishing Corporation, New York, NY, or in U.S. Pat. No. 3,419,935. Although the specific design of the autoclave 40 may vary, the autoclave should be capable of heating the rigid ceramic material 32 and container 22 to a temperature sufficient to cause plastic deformation of the metal powder in the container 22, and subsequent diffusion bonding of the powder particles.

In one specific instance, the autoclave 40 heated the container 22 and rigid ceramic material 32 to a temperature of approximately 1,700° F. Argon gas pressure of 30,000 lbs. per square inch was provided within the autoclave 40 to compact the container 22 and metal powder 28. To provide for compaction and diffusion bonding of the metal powder 28 in the sealed container 22, the argon gas pressure of 30,000 psi and temperature of 1,700° F. were maintained in the autoclave for a period of approximately two hours.

Figure 11:
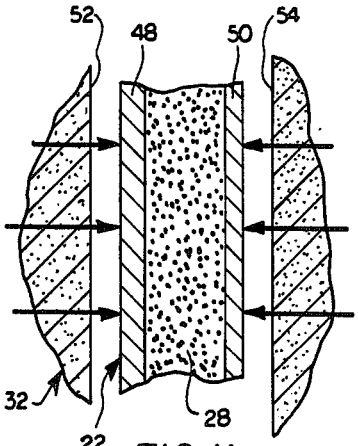
FIG. 11 is an enlarged schematic sectional view, generally similar to FIG. 10, illustrating the manner in which side surface areas of the container are moved away from side surfaces of the rigid ceramic body under the influence of fluid pressure during compaction in the furnace of FIG. 9.

The fluid pressure against the side walls 48 and 50 of the heated container 22 moves the side walls inwardly away from inner side surfaces 52 and 54 of the ceramic block 32 in the manner shown schematically in FIG. 11. As this occurs, the metal powder 28 in the container 22 is compacted and, over a period of time, diffusion bonded to form the turbine blade or vane 10 of FIG. 1. During the entire hot isostatic pressing operation, the container 22 remains sealed so that the argon gas cannot enter the container.

Figure 12:
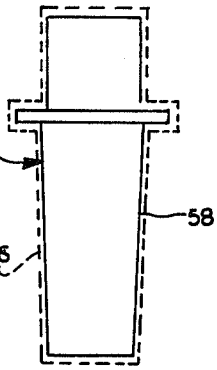
FIG. 12 is a schematic illustration depicting the relationship between the compacted container of metal powder and an initial spatial boundary which was occupied by the container of metal powder prior to compaction.

During the compaction of the metal powder 28 in the container 22, the container is also compacted. Thus, the container 22 is pressed inwardly from an initial size, indicated in dashed lines at 56 in FIG. 12 to a compacted size, indicated in solid lines at 58 in FIG. 12. During this compaction, the space occupied by the container 22 decreases. Although the extent of linear compaction of the container 22 and metal powder 28 will vary depending upon the physical dimensions of the metal powder, the fractional decrease in the thickness of the airfoil portion of the container may be approximately 13% to 15% during compaction In accordance with a feature of the present invention, the rigid ceramic body 32 prevents the occurrence of excessive deformation or distortion of the container 22. Thus, during compaction of the elongated container 22 and the metal powder 28, the rigid ceramic body 32 blocks the container from moving out of its initial spatial boundary, indicated at 56 in FIG. 12.

Figure 13:
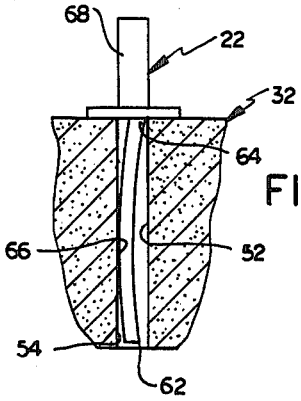
FIG. 13 is a schematic illustration depicting the manner in which the rigid body of fluid permeable material prevents excessive distortion of the container of metal powder during compaction.

During the hot isostatic pressing, stresses in the side walls of the container 22 may tend to cause the container to bow in the manner illustrated schematically in FIG. 13. In this instance, tip and root end portions 62 and 64 of the container 22 abut inner the side surface 52 of the ceramic block 32. A central portion 66 of the container abuts the opposite inner side surface 54 of the rigid ceramic block 32. The abutting engagement between the container 22 and the inner surfaces 52 and 54 of the rigid block 32 prevent the container from deflecting out of its initial spatial boundary or envelope, indicated at 56 in FIG. 12, under the influence of stresses induced in the container during the hot isostatic pressing process.

The root end portion 68 of the container 22 projects from the rigid body 32 to enable the container to expand axially when it is heated and to contract axially under the influence of fluid pressure. Thus, when the container 22 is initially being heated in the autoclave 40, the container is free to expand in an axial direction since the root end portion of the container projects out of the block 32. It should be noted that the tip end 62 of the container (FIG. 13) is disposed adjacent to an opening in the lower end of the block 32 and can also expand axially. During the subsequent compaction of the metal powder 28, the container 22 is free to shift axially relative to the block 32 under the influence of fluid pressure. If the tip and root end portions 62 and 68 of the container 22 wer tightly enclosed by the ceramic block 32, the container would be held against axial expansion and contraction and would tend to distort or even tear during expansion and/or contraction of the container.

Rigid Body Of Fluid Permeable Material—Second Embodiment

Figure 14:
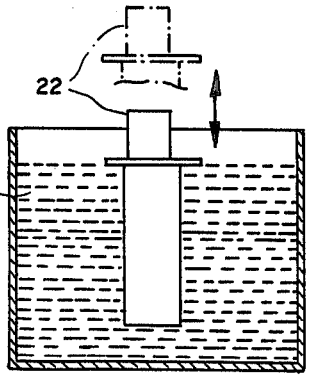
FIG. 14 is a schematic illustration of another embodiment of the method by which the rigid body of fluid permeable material is formed around the sealed container of metal powder by repetitively dipping the container in a slurry of ceramic material.
Figure 15:
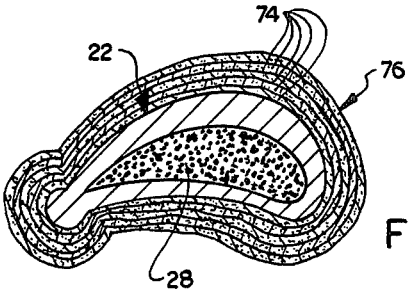
FIG. 15 is a sectional view illustrating the relationship between the container of metal powder and layers of ceramic material built up around the container during the repetitive dipping of the container in the slurry of ceramic material.

The rigid body 32 of fluid permeable material can be formed around the container 22 by repetitively dipping the filled and sealed container in a slurry 72 of ceramic material in the manner illustrated schematically in FIG. 14. Thus, the sealed container 22 is dipped in the slurry and then raised upwardly to the position shown in dashed lines in FIG. 14 and held until a layer of ceramic material on the container partially dries. This process is repeated until a plurality of layers 74 (see FIG. 15) of slurry have been built up around the container 22. The layers of ceramic material over the container 22 are then hardened to form a rigid body 76 of fluid permeable material.

The sealed container 22 and the rigid body 76 of fluid permeable material are then subjected to a hot isostatic pressing operation in the autoclave 40. During this pressing operation, the fluid pressure applied against the side walls of the container 22 moves the side walls inwardly away from the inner side surface of the rigid body 76 of ceramic material in the manner previously described in connection with the ceramic block 32 of FIGS. 9–11.

Rigid Body Of Fluid Permeable Material—Preformed Blocks

Instead of forming the rigid body of fluid permeable material around the container 22 by surrounding the container with ceramic slurry and hardening the slurry, rigid blocks 78 and 80 (FIG. 16) of fluid permeable ceramic material may be used. The rigid blocks 78 and 80 have inner side surfaces 82 and 84 which are shaped to tightly fit against opposite sides of the container 22 (FIG. 17). Thus, the sealed and filled container 22 is placed with the convex side wall 48 in tight abutting engagement with the concave surface 84 of the block 80 throughout the extent of the convex side wall. The concave container side wall 50 is placed in tight abutting engagement with the convex surface 82 of the block 78 throughout the extent of the concave side wall.

The surfaces 82 and 84 of the blocks 78 and 80 have the same configuration and extent as external surfaces of the container 22. Therefore, downwardly facing flat side surface areas 88 and 90 (FIG. 16) on the upper block 78 are disposed in flat abutting engagement with upwardly facing flat side surfaces 92 and 94 on the lower block 80. A weight or metal bar 100 (FIG. 17) is placed on top of the upper ceramic block 78. The weight 100 and ceramic blocks 78 and 80 are pressed together by suitable clamping elements or wires 102 and 104 which extend around the ceramic blocks.

Figure 10:
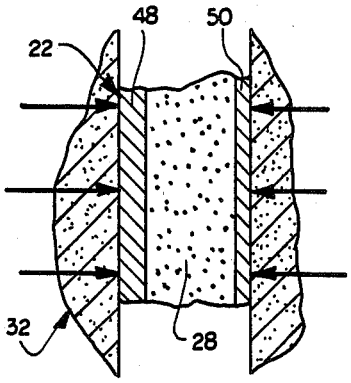
FIG. 10 is an enlarged schematic sectional view of the manner in which fluid pressure is transmitted through the porous ceramic body and acts against a portion of the container during compaction in the furnace of FIG. 9.

The ceramic blocks 78 and 80, container 22 and weight 100 are then positioned in the autoclave 40 (FIG. 9) and subjected to the hot isostatic pressing process in the manner previously explained in connection with FIGS. 9–11. As this occurs, the pressure of the argon gas in the autoclave is transmitted through the fluid permeable blocks 78 and 80 to compact the sealed container 22 and metal powder 28. As the container 22 is compacted, its side surfaces 48 and 50 move away from the concave and convex surfaces 82 and 84 of the blocks 78 and 80 in a manner similar to the schematic illustrations of FIGS. 10 and 11. As this is occurring, the weight 100 and clamping elements or wires 102 and 104 hold the rigid blocks 78 and 80 against relative movement. This prevents the container 22 from deflecting outside of its initial spatial boundary to thereby prevent excessive deformation of the container as the metal powder 28 in the container is diffusion bonded to form the airfoil 10. The manner in which the blocks 78 and 80 prevent excessive deformation of the container 22 during the hot isostatic pressing process is similar to the manner in which the block 32 of FIG. 13 prevents excessive deformation of the container.

Figure 16:
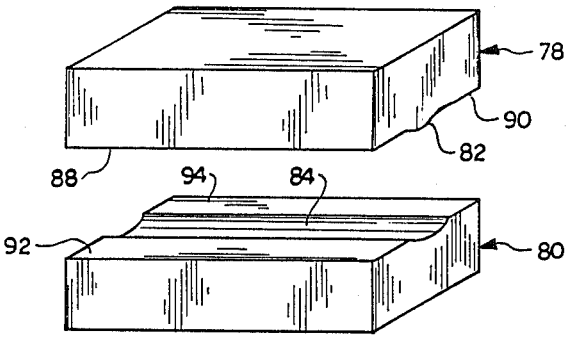
FIG. 16 is a schematic pictorial illustration of rigid blocks of fluid permeable ceramic material used to enclose the container of metal powder during the practicing of another embodiment of the method of the present invention.
Figure 17:
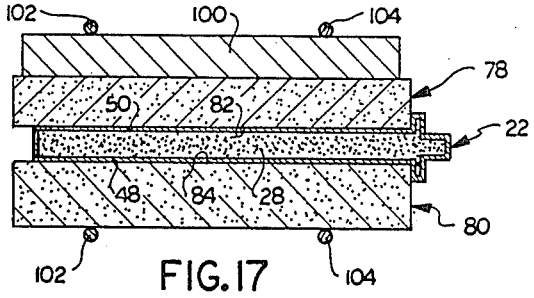
FIG. 17 is a schematic sectional view illustrating the manner in which the rigid blocks of FIG. 16 are used to enclose the container of metal powder.

In the embodiment shown in FIGS. 16 and 17, the blocks 78 and 80 and the inner side surfaces 82 and 84 are shaped to have the blocks disposed in flat abutting engagement with each other prior to compaction of the container 22. However, it is contemplated that the blocks 78 and 80 could be shaped to leave a gap which would be closed as the container of powder metal is compacted. Thus, in the embodiment of the invention shown in FIGS. 18 and 19, rigid fluid permeable ceramic blocks 110 and 112 have concave and convex inner side surfaces, corresponding to the side surfaces 82 and 84 of the blocks of FIG. 16, which have the same shape as opposite sides of the sealed container 22 of metal powder. Therefore, the side surfaces 82 and 84 abut the container 22 in the manner shown in FIG. 19.

Figure 18:
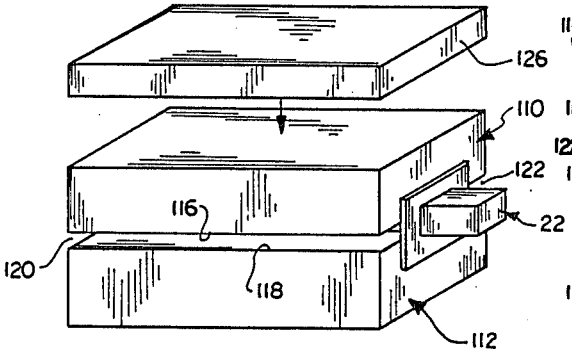
FIG. 18 is a schematic illustration of the manner in which a pair of rigid blocks of fluid permeable ceramic material enclose a container of metal powder with a gap between the blocks prior to compaction of the metal powder, the size of the gap being exaggerated for purposes of illustration.
Figure 19:
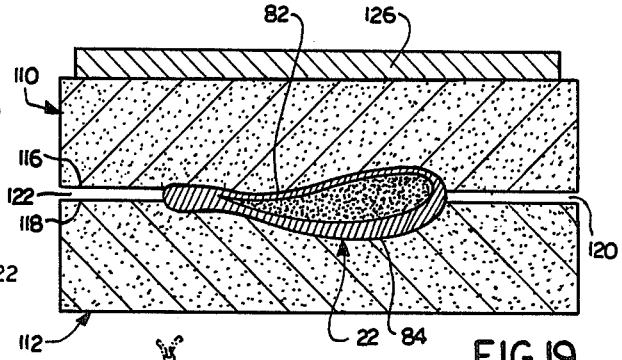
FIG. 19 is an end view further illustrating the relationship between the container and blocks of FIG. 18.

In the embodiment of the invention shown in FIGS. 18 and 19, the concave and convex surfaces of the blocks 110 and 112 have a circumferential extent which is less than the extent of the side surfaces 48 and 50 of the container 22. Therefore, the flat side surfaces 116 and 118 of the blocks 110 and 112 are separated by a pair of gaps 120 and 122 disposed on opposite sides of the container 22. The size of the gaps 120 and 122 has been exaggerated in FIGS. 18 and 19 for purposes of clarity of illustration. The gaps 120 and 122 would actually be approximately 0.020 inches wide if the thickness of the metal powder at a section along the central axis of the container 22, that is, in the plane shown in FIG. 17, was approximately 0.150 inches.

A weight 126 is placed on the upper block 110. The blocks 110 and 112, sealed container 22 and weight 126 are then placed in the autoclave 40 for a hot isostatic pressing operation. During the hot isostatic pressing operation, the container 22 and the metal powder in the sealed container are compacted. As the container 22 is compacted, the upper block 110 is moved toward the lower block 112 under the influence of the weight 126 to close the gaps 120 and 122. It is preferred to fully close the gaps 120 and 122 by bringing the side surfaces 116 and 118 into flat abutting engagement. However, the gaps 120 and 122 could be only partially closed if desired.

In the embodiment of the invention shown in FIGS. 16–19, the rigid fluid permeable blocks 78, 80, 110, and 112 were urged together under the influence of a weight. However, the forces tending to cause excessive deformation or distortion of the container 22 may be greater than the magnitude of the weights 100 and 126. Therefore, it may be desired to press the rigid blocks toward each other with a clamping force which is maintained substantially constant or even increased during the hot isostatic pressing process. In the embodiment of the invention illustrated in FIG. 17, the wires or clamping elements 102 and 104 elongate due to thermal expansion of the metal in the wires so that the clamping force applied against the weight 100 and the blocks 78 and 80 by the wires 102 and 104 is eliminated or is at least reduced as the temperature increases during the hot isostatic pressing process.

Figure 20:
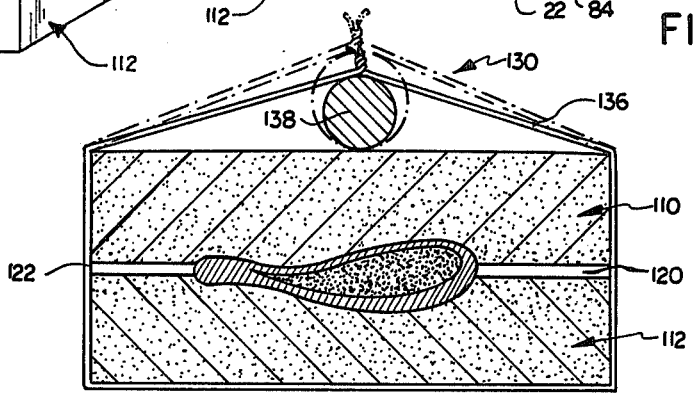
FIG. 20 is a schematic illustration of an embodiment of the invention in which a temperature compensated clamp is used to press a pair of rigid blocks of fluid permeable ceramic material against a container of metal powder.

In the embodiment of the invention illustrated in FIG. 20, a thermally compensated clamp assembly 130 maintains a clamping force against rigid fluid permeable blocks 110 and 112 during the hot isostatic pressing process. To achieve this, a wire or clamping element 136 is formed of a material which has a relatively small coefficient of thermal expansion. A compensating bar or body of metal 138 has a relatively large coefficient of thermal expansion. The bar 138 is placed between the wire 136 and the upper surface of the ceramic block 110.

The diameter and coefficient of thermal expansion of the compensating bar 138 is related to the length and coefficient of thermal expansion of the wire 136 to maintain clamping force in the wire as it is heated. Thus, the increase in the diameter of the bar 138 due to thermal expansion with increasing temperature, will be sufficient to offset the increase in length of the wire 136, due to thermal expansion. As the temperature of the bar 138 is raised, the bar expands, in a manner which is greatly exaggerated in dash lines in FIG. 20. At the same time, the length of the wire 136 increases in the exaggerated manner illustrated in dash lines in FIG. 20. Since the wire extends around both sides of the bar 138, an incremental increase in the diameter of the bar 138 will take up or compensate for two increments of increase in the length of the wire 136. Although only a single compensating bar 138 has been shown in FIG. 20, it should be understood that a pair of bars could be used if desired. Thus, one bar could be placed against the block 110, as shown in FIG. 20, and a second bar could be placed between the wire 136 and block 112.

A pair of gaps 120 and 122 may be provided between the side surfaces of the blocks 110 and 112 in the manner previously explained in regard to the embodiment of the invention shown in FIGS. 18 and 19. If this was done, the diameter and coefficient of thermal expansion of the bar 138 would be related to the length and coefficient of thermal expansion of the wire 136 in such a manner as to maintain the clamping force of the blocks 110 and 112 as the gaps 120 and 122 are closed.

Although it is contemplated that the diameter and coefficient of thermal expansion of the bar 138 will be related to the length and coefficient of thermal expansion of the wire 136 to maintain a substantially constant clamping force against the blocks 110 and 112, the dimensions and coefficients of thermal expansion of the bar and wire could be related to each other in such manner as to increase the clamping force applied against the blocks 110 and 112 as the temperature to which they are exposed is increased. In either case, the size of a unit dimension of the compensating bar 138 will increase by a greater amount than the size of a unit dimension of the wire 136 during heating of the blocks 110 and 112, the wire and the bar.

Although many different types of materials could be used for the wire 136 and bar 138, it is contemplated that the bar could be made of a 300-series stainless steel or a 21-4-N valve steel and that the wire 136 could be formed of an A-286 iron superalloy. Although only a single wire 136 has been shown in FIG. 20, it is contemplated that a plurality of wires could be used if desired, in a manner similar to FIG. 17. Although the wire 136 has been shown as merely extending around only one side of the bar 138, it is contemplated that the bar and wire could be interrelated in a different manner. For example, the bar 138 could have a flat configuration and the wire 136 could be wrapped completely around the bar and then wrapped around the blocks 110 and 112.

Figure 21:
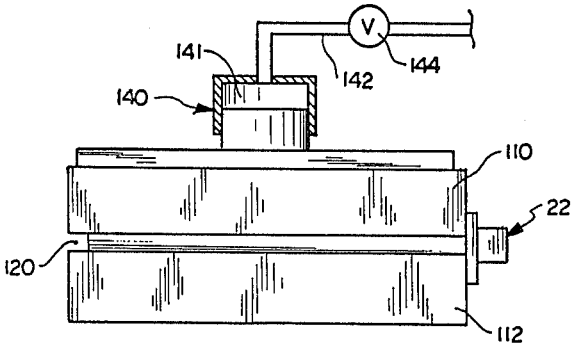
FIG. 21 is a schematic illustration of another embodiment of the invention depicting the manner in which fluid pressure may be used to urge the rigid blocks of fluid permeable ceramic material toward each other during compaction of metal powder in a container between the blocks.

Rather than using the weight 126 to press the blocks together, it is contemplated that a piston and cylinder assembly 140 (FIG. 21) could be used to press the two blocks 110 and 112 together. The piston and cylinder assembly 140 includes a variable volume chamber 131 which is connected with a source of fluid pressure through a conduit 142 and valve 144. The fluid pressure in the piston and cylinder assembly 140 presses the upper block 110 toward the lower block 112 to close the gaps 120 and 122 as the sealed container 22 is compacted under the influence of fluid pressure conducted through the fluid permeable and rigid blocks 110 and 112.

In the embodiment illustrated in FIGS. 16–21, the rigid blocks 78, 80, 110 and 112 of fluid permeable material have inner side surfaces, corresponding to the side surfaces 82 and 84 of FIG. 16, which have the same configuration as the configuration of the portion of the outer side surface of the container 22 engaged by the blocks. In the embodiment of the invention shown in FIG. 22, a pair of blocks 145 and 146, formed of a rigid and fluid permeable ceramic material, are provided with inner surfaces 147 and 148 which have curvatures different than the curvatures of the outer side surfaces of the sealed container 22 of metal powder.

The inner side surface 147 of the upper block 145 has a radius of curvature which is smaller than the radius of curvature of the upper side surface 82 of the container 22. Similarly, the inner side surface 148 of the lower block 146 has a radius of curvature which is smaller than the radius of curvature of the outer side surface 84 of the container 22. During compaction of the sealed container 22, the blocks 145 and 146 are moved toward each other under the influence of a weight similar to the one shown in FIG. 17 or a pneumatic spring similar to the one shown in FIG. 19, or a thermally compensated clamp assembly similar to the one shown in FIG. 20. The curvatures of the side surfaces 82 and 84 of the container 22 change to correspond to the curvatures of the inner side surfaces 147 and 148 of the rigid, fluid permeable ceramic blocks 145 and 146 as the blocks move toward each other.

Blade, Pattern and Container

The turbine blade 10 (FIG. 1) has a root or base portion 150 with a generally rectangular platform 152. An airfoil portion 154 extends outwardly from the platform 152. The airfoil portion 154 has a bowed and twisted configuration. The shape and configuration of the turbine blade 10 is well known and will vary depending upon the type of engine in which the blade is to be used and the location of the blade within the engine. It should be understood that although a specific turbine blade 10 has been shown in FIG. 1, other types of vanes and blades as well as other articles could be formed by the method of the present invention and it is not intended to limit the invention to a specific turbine blade.

The turbine blade 10 is formed of spherical titanium powder, that is PREP (Plasma Rotating Electrode Powder) Ti-6A1-4V. Of course, other types of metal powder alloys, such as a cobalt alloy or a nickel superalloy, such as IN-100 could be used. The specific composition of the metal powder alloy from which the vane or blade 10 is formed will depend upon the environment in which the vane or blade is to be used and the operating stresses to which the blade is to be subjected.

To form the container 14, it is necessary first to form a pattern 12 having a configuration corresponding to the configuration of the blade 10. Although the configuration of the pattern 12 corresponds to the configuration of the blade 10, the pattern 12 is slightly larger than the blade 10 to compensate for compaction of the metal powder. Thus, the pattern 12 includes a root portion 158, a platform 160, and a blade portion 162 which have the same configuration as the corresponding portions of the turbine blade 10. In addition, a pair of generally cylindrical projections 164 and 166 are provided at the root and tip ends of the pattern 12.

The pattern 12 is formed by injecting hot wax or plastic into an accurately formed master die. The master die has a cavity which corresponds to the desired configuration of the pattern 12. However, the size of the master die cavity is slightly larger than the pattern 12 to compensate for shrinkage of the pattern material. Once the wax or plastic has solidified in the master die cavity, the die is opened and the pattern removed from the master die. The manner in which the pattern 12 is formed is the same as is commonly used in the formation of patterns used in the investment casting process.

The outer surface of the wax pattern 12 is then made electrically conductive by spraying a continuous layer of silver or graphite over the entire outer surface of the pattern. Although it is preferred to spray the pattern with silver or graphite, any other conductive material could be sprayed onto the pattern. It is also contemplated that the outer surface of the pattern could be made conductive by application of an electroless nickel or nickel-cobalt coating or by vapor deposition of any other metal.

The electrically conductive outer surface of the pattern 12 is then electroplated with nickel to form a continuous thin metal layer over the pattern. During the electroplating process, the pattern is the cathode and the anode is formed of nickel. During the electroplating of the layer 14 (FIG. 3) of nickel over the pattern 12, there is an uneven deposition of nickel. In the past, this has resulted in the convex side of the airfoil portion 162 of the pattern being covered with a thicker layer of the electroplated nickel than the concave side of the airfoil (see FIG. 3). In addition, the electroplated material tends to accumulate at the relatively sharp trailing edge of the airfoil portion 162 of the pattern 12 in the manner indicated schematically in FIG. 3, and at the tip end.

The extent of the variation in the thickness of the layer 14 of nickel over the pattern 12 can, to some extent, be controlled by providing auxiliary cathodes or thiefs, controlling the flow of electrolyte during electroplating, and providing shields of a nonconductive material. Although the variations in the thickness of the layer 14 of nickel can be controlled, to some extent, by the use of these known electroplating techniques, the layer 14 will still have variations in its thickness. Therefore, the configuration of the outer side surface of the metal layer 14 does not correspond exactly to the configuration of the pattern but has a configuration which is a function of the configuration of the pattern. This can be seen in FIG. 3 wherein the outer side surface of the layer 14 has a bulbous portion adjacent to the trailing edge of the airfoil portion of the pattern 12.

In order to minimize the cost of the electroplating operation, the layer 14 of nickel should be as thin as possible. However, the thinnest area of the layer 14 of nickel must be strong enough to withstand the relatively high fluid pressures (approximately 30,000 pounds per square inch) required for the hot isostatic pressing operation without rupturing. Thus, the side walls of the container 22 must be capable of uniformly collapsing, as shown in FIG. 11, under the influence of fluid pressure at high temperatures (approximately 1700° F. for the case of titanium and 2000° F. for nickel superalloy) while the container 22 remains fluid tight so that the high pressure argon gas on the outside of the container cannot enter the container. Although the thickness of the layer 14 of metal deposited on the pattern 12 will vary, the layer of metal has an average thickness of approximately 0.015 inches. Of course, metal layers 14 having average thicknesses which are different than the specific thickness set forth above could be used if desired.

Once the thin metal layer 14 has been deposited over the pattern 12, the pattern is removed to form the container 22. To remove the pattern 12, the circular outer end surfaces of the projections 16 and 18 are cut away to form openings to the interior of the layer 14 of metal. The pattern 12 and layer 14 of metal are then heated to a temperature above the melting point of the wax material forming the pattern 12 and below the melting point of the layer 14 of metal. The melted wax then flows out of the open end of the projection 16 at the tip end of the layer 14 of metal. The remaining wax is cleaned out of the interior of the layer 14 of metal by conducting a flow of hot solvent from the open end of the root portion projection 18 to the open end of the tip portion projection 16.

The layer of silver, if the pattern 12 was made conductive with silver, is then removed by a flow of a suitable reagent, such as nitric acid solution. The flow of the nitric acid solution is conducted from the opening at the root end projection 18 to the opening at the tip end projection 16. This results in the formation of the elongated container 22 (see FIG. 4) having a cavity 24 with a configuration which corresponds to the configuration of the pattern 12 and the configuration of the turbine blade 10. If the powder being consolidated is titanium, and the pattern 12 was made conductive with graphite, then the graphite is not removed from the inside of the container since the graphite serves the useful function of minimizing the diffusion of nickel into the titanium. However, due to the relatively thick convex side wall 48, the relatively thin concave side wall 50, and the generally bulbous accumulation of material 170 adjacent to the portion of the cavity corresponding to the trailing edge of the airfoil, the container 22 has an outer side surface with a configuration which differs somewhat from the configuration of the pattern 12 and turbine blade 10.

The opening at the tip end projection 16 of the container is then sealed and the container is filled with metal powder through the opening at the root end projection 18. The filling of the container 22 with metal powder is advantageously performed in a vacuum to facilitate a flow of the metal powder 28 into the container. If the cavity 24 contains air upon initiation of the pouring of the metal powder 28 into the container 22, the outward flow of air through the open root end projection 18 will impede the inward flow of metal powder. Therefore, it is preferred to evacuate the container cavity 24 before initiating the flow of metal powder 28 into the container. After the container has been filled, the opening at the root end projection 18 is sealed in a vacuum environment. Once the root end projection 18 has been sealed, the container 22 can be removed from a vacuum environment into the atmosphere without the atmosphere entering the cavity 24.

Although the thin metal of the container 22 has insufficient structural strength to support the container during a hot isostatic pressing operation so that distortion or excessive deformation of the container would occur, in the absence of the rigid body of fluid permeable material, the thin metal of the container 22 does have sufficient structural strength to be self-supporting during the filling of the container with metal powder and the subsequent handling of the container. The general process by which the container 22 is formed is similar to the process disclosed in U.S. Pat. Nos. 4,023,966 and 4,065,303 and will not be further described herein in order to avoid prolixity of description.

Container Deflection

If the unsupported thin metal container 22 was subjected to hot isostatic pressing in the autoclave 40 (FIG. 9) at the temperature and pressure necessary to compact the metal powder 28, excessive deformation of the container 22 would occur. Thus, one specific container 22 bowed to the generally banana shaped configuration illustrated schematically in FIG. 6 when the container was subjected to a hot isostatic pressing operation without exterior support. Although it is not known exactly why the excessive deformation or distortion of the container occurred during the pressing operation, it is believed that it was due to stresses induced in the container 22 as a result of the differences in thickness and lengths of the various portions of the container.

When the container 22 is enclosed with a rigid body of fluid permeable material, in the manner previously described, the container 22 decreases in volume, i.e., undergoes a controlled collapse during the hot isostatic pressing operation. The extent of the deflection will vary, but for the case of spherical powder, the volumetric collapse amounts to 30%–70%, which constitutes a 15%–20% linear decrease. However, it is believed that the use of the rigid fluid permeable bodies of material of FIGS. 8, 15, 16, 18 and 20 will allow turbine blades to be formed, on a production basis, of metal powder with a thickness which will vary by ±0.005 inches or less from a desired airfoil thickness and a twisted and bowed side surface configuration which will vary along the length of the airfoil by +0.010 of an inch or less from a desired configuration. The forming of turbine blades with this degree of accuracy is the result of the use of the rigid bodies of fluid permeable material to hold the container 22 against excessive deflection under the influence of stresses induced in the walls of the container during heating and compacting of the container and the metal powder in the container.

Rigid Body of Fluid Permeable Material

Figure 7:
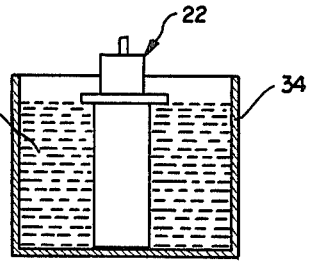
FIG. 7 is a schematic illustration of the manner in which a slurry of ceramic material is molded around the container of FIGS. 4 and 5 after the container has been filled with metal powder and sealed.
Figure 8:
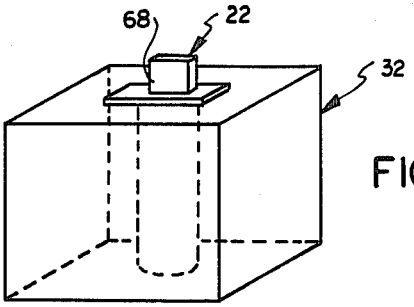
FIG. 8 is a schematic illustration of the container enclosed by a rigid body of fluid permeable material formed by hardening the ceramic slurry of FIG. 7.

In one specific instance, the container 22 was enclosed in a rigid body of fluid permeable material by surrounding the container 22 with the ceramic slurry 36, in the manner illustrated schematically in FIG. 7. The body of slurry 36 was, in this specific instance, a castable silica sold under the trademark "TAYCOR" by Taylor Refractories Corporation of Cincinnati, Ohio. The castable silica was designated as a No. 414F ceramic by Taylor Refractories Corporation. Although this specific ceramic slurry was used, it should be understood that other known slurries containing silica, zircon, and binders and having compositions generally similar to the compositions described in U.S. Pat. Nos. 4,093,017; 4,128,431; 4,131,475; and 4,236,568 could be used, if desired.

The same type of ceramic material could be used to form the rigid fluid permeable blocks 78, 80, 110, 112, 145 and 146 of FIGS. 16–22. However, it is not intended that the present invention be limited to the use of any particular material to form the rigid fluid permeable body which encloses the container 22.

Summary

The present invention provides a new and improved method of forming an article, such as the turbine blade or vane 10, from metal powder. In practicing the method, a metal container 22 having an interior cavity 24 with a configuration corresponding to the configuration of the article is formed. The container 22 is filled with metal powder 28 and sealed. The thin metal container 22 has sufficient structural strength to be self-supporting during filling of the container.

The sealed container 22 is then at least partially enclosed with a rigid body of fluid permeable material. The rigid body of fluid permeable material can be solidified around the container 22 (FIGS. 7 and 14) or be preformed to receive the container 22 (FIGS. 16–22).

The sealed container 22 and the metal powder 28 in the container are then subjected to a hot isostatic pressing process during which the container is heated and exposed to fluid pressure. The fluid pressure is transmitted through the rigid body and is applied against the outer side surfaces of the container to compact the container 22 and heated metal powder 28. As the container 22 and metal powder are compacted, the side walls of the container are moved away from inner side surface areas of the rigid body of fluid permeable material in the manner illustrated schematically in FIGS. 10 and 11. Although the thin metal container 22 has insufficient structural strength to withstand distorting stresses and to be self-supporting without sagging during the hot isostatic pressing process, the container does have sufficient strength to withstand the fluid pressure of the pressing process without rupturing.

During the compacting of the metal powder 28, stresses are induced in the side walls of the container 22. These stresses tend to cause excessive deflection or distortion of the container 22. However, deflection of the container 22 is blocked by the rigid body of fluid permeable material. In addition to preventing excessive deflection of the container 22 under the influence of the stresses which are induced during compaction of the metal powder 28, the rigid body of fluid permeable material supports the container 22 so as to prevent excessive sagging of the container after it has been heated to the temperature necessary to obtain diffusion bonding of the metal powder.

Figure 22:
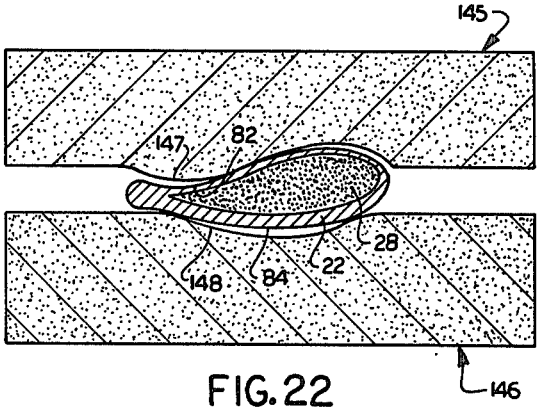
FIG. 22 is an enlarged schematic illustration illustrating the relationship between the container of metal powder and a rigid block of fluid permeable ceramic material having side surfaces with curvatures which differ from the curvatures of side surfaces of the container of metal powder.

The rigid body of ceramic material can be formed around the filled and sealed container 22 in many different ways. Specifically, a rigid body of ceramic material may be molded around the sealed container 22 (FIG. 7) or may be formed around the sealed container by repetitively dipping the container in a slurry of ceramic material (FIG. 14). However, it may be preferable to enclose the sealed container 22 with a pair of rigid ceramic blocks 78 and 80, 110 and 112 or 145 and 146 having preformed surfaces for engaging the container. The preformed surfaces may either have a configuration which corresponds to the configuration of the side surfaces of the container 22 (FIGS. 16–21) or may have a configuration which is somewhat different than the configuration of the side surfaces of the container (FIG. 22). Although the blocks may initially be placed in flat abutting engagement with each other (FIGS. 16 and 17), it may be preferred to leave a gap between the blocks and to close this gap as the container of metal powder is compacted (FIGS. 18–21). In any case, the blocks are held in close proximity to the container 22 by means of a temperature-compensated clamping arrangement 130 or by dead weights 100 and 126, or by a pressure clamp 140, or by some other means.

Having described specific preferred embodiments of the invention, the following is claimed:

1. A method of forming an article from metal powder, said method comprising the steps of providing a metal container having an interior cavity with a configuration corresponding to the configuration of the article and having side walls with outer side surfaces which define an initial spatial boundary of the container, filling the cavity in the container with metal powder, sealing the filled container so that fluid pressing against the outer side surfaces of the container cannot enter the cavity, thereafter, enclosing at least a portion of the filled and sealed container with a rigid body of fluid permeable ceramic material having inner side surface areas disposed in engagement with outer side surfaces of the container, transmitting heat and fluid pressure through the rigid body of fluid permeable ceramic material to the container, said step of providing a container includes the step of providing a container having sufficient structural strength to be self-supporting during filling of the container and insufficient structural strength to be self-supporting without sagging during performance of the step of transmitting heat and fluid pressure to the container, compacting the heated metal powder in the container under the influence of the fluid pressure transmitted through the rigid body of fluid permeable ceramic material without deforming the rigid body of fluid permeable ceramic material, said step of compacting the heated metal powder including the steps of maintaining the size and configuration of the rigid body of fluid permeable ceramic material constant, reducing the size of the container to provide space between portions of outer side surfaces of the container and inner side surface areas of the rigid body of fluid permeable ceramic material, and inducing in the container stresses tending to deflect the container to a configuration in which at least a portion of the container would be outside the initial spatial boundary of the container, said method further including the step of maintaining the container within the initial spatial boundary of the container against the influence of stresses induced in the container during the compacting of the metal powder by blocking movement of portions of the container out of the initial spatial boundary of the container with the inner side surface areas of the rigid body of fluid permeable ceramic material while maintaining the configuration of the inner side surface areas of the rigid body of fluid permeable ceramic material constant to thereby effect compaction of the metal powder in the container to a configuration which at least closely approximates the desired configuration of the article.

2. A method as set forth in claim 1 wherein said step of enclosing the container with a rigid body of fluid permeable ceramic material includes the steps of providing a body of ceramic slurry, surrounding the filled and sealed container with the body of ceramic slurry, and hardening the body of ceramic slurry around the container.

3. A method as set forth in claim 1 wherein said step of reducing the size of the container to provide space between portions of outer side surfaces of the container and inner side surface areas of the rigid body of ceramic material includes moving surfaces areas of the container into a spaced apart relationship with inner side surface areas of the rigid body of fluid permeable ceramic material.

4. A method as set forth in claim 1 wherein said step of enclosing the container with a rigid body of fluid permeable ceramic material includes the steps of providing a body of ceramic slurry, repetitively dipping at least a portion of the filled and sealed container in the body of ceramic slurry, and hardening layers of the ceramic slurry built up over the outside of the container during the performance of the step of repetitively dipping the container in the body of ceramic slurry.

5. A method as set forth in claim 1 wherein said step of enclosing the container with a rigid body of fluid permeable ceramic material includes the step of providing first and second rigid members formed of a fluid permeable ceramic material and placing the members in engagement with side surfaces of the filled and sealed container.

6. A method of forming an article from metal powder, said method comprising the steps of providing a metal container having an interior cavity with a configuration corresponding to the configuration of the article and having side walls with outer side surfaces which define an initial spatial boundary of the container, filling the cavity in the container with metal powder, sealing the filled container so that fluid pressing against the outer side surfaces of the container cannot enter the cavity, thereafter, enclosing at least a portion of the filled and sealed container with a rigid body of fluid permeable material having inner side surface areas disposed in engagement with outer side surfaces of the container, transmitting heat and fluid pressure through the rigid body of fluid permeable material to the container, compacting and diffusion bonding the heated metal powder in the container under the influence of the fluid pressure transmitted through the rigid body of fluid permeable material while maintaining the container intact, said step of compacting and diffusion bonding the heated metal powder including the steps of providing space between portions of outer side surfaces of the container and inner side surface areas of the rigid body of fluid permeable material by moving surface areas of the container into a spaced apart relationship with the inner side surface areas of the rigid body of fluid permeable material and inducing in the container stresses tending to deflect the container to a configuration in which at least a portion of the container would be outside the initial spatial boundary of the container, said step of providing a metal container includes the step of providing a container having sufficient structural strength to be self-supporting during filling of the container and insufficient structural strength to be self-supporting without deformation during performance of said step of transmitting heat and fluid pressure to the container, said method further including the step of maintaining the container within the initial spatial boundary of the container against the influence of stresses induced in the container during the compacting and diffusion bonding of the metal powder by blocking movement of portions of the container out of the initial spatial boundary of the container with the rigid body of fluid permeable material to thereby effect compaction of the metal powder in the container to a configuration which at least closely approximates the desired configuration of the article.

7. A method as set forth in claim 6 wherein the step of providing a container includes providing an elongated container, said method further including increasing the axial length of the container without resistance from the rigid body of fluid permeable material during said step of transmitting heat to the container and decreasing the axial length of the container without resistance from the rigid body of fluid permeable material during said step of compacting the metal powder in the container.

8. A method as set forth in claim 7 wherein said step of enclosing the container with the rigid body of fluid permeable material includes the step of leaving one end portion of the container projecting outwardly from the rigid body of fluid permeable material.

9. A method as set forth in claim 6 wherein said step of providing a container includes the steps of providing a pattern having a configuration which corresponds to the configuration of the article, electroplating a layer of metal over the pattern, building up different metal thicknesses over different portions of the pattern during said step of electroplating a layer of metal over the pattern, and removing the pattern from within the layer of metal to leave the container, said step of enclosing at least a portion of the container with a rigid body of fluid permeable material including the step of shaping inside surface areas of the rigid body of fluid permeable material to have a configuration which differs from the configuration of the pattern by an amount which is a function of the variations in the thickness of the metal built up over different portions of the pattern during said step of electroplating a layer of metal over the pattern.

10. A method as set forth in claim 6 wherein said step of providing space between portions of the side surfaces of the container and inner side surface areas of the rigid body of fluid permeable material includes providing space between opposite outer side surfaces of the container and inner side surfaces of the rigid body of fluid permeable material at a location along the container.

11. A method of forming an article from metal powder, said method comprising the steps of providing a thin metal container having an interior cavity with a configuration corresponding to the configuration of the article and having side walls with outer side surfaces having a configuration which is different than the configuration of the article, said step of providing a metal container including the steps of electroplating a thin layer of metal over a pattern and then removing the pattern from the layer of metal to form a container having sufficient structural strength to be self-supporting during filling of the container with metal powder and having insufficient structural strength to be self-supporting without deformation after the container has been filled with metal powder and heated to a temperature sufficient to promote diffusion bonding of the particles of metal powder in the container, filling the container with metal powder, sealing the filled container so that fluid pressing against the container cannot enter the cavity, enclosing at least a portion of the container with a rigid body of fluid permeable material having side surface areas disposed in engagement with outer side surfaces of the container, said step of enclosing the container with a rigid body of fluid permeable material including the step of shaping the inside surface areas of the rigid body of fluid permeable material to have a configuration which corresponds to the configuration of the outer side surfaces of the container and differs from the configuration of the article, heating the container and metal powder in the container to a temperature sufficient to promote diffusion bonding of the particles of metal powder by transmitting heat through the rigid body of fluid permeable material to the container, compacting the heated metal powder in the container under the influence of the fluid pressure transmitted through the rigid body of fluid permeable material, said step of compacting the heated metal powder including the steps of providing space between portions of the outer side surfaces of the container and inner side surface areas of the rigid body of fluid permeable material by moving side surface areas of the container into a spaced apart relationship with the inner side surface areas of the rigid body of fluid permeable material, said method further including the step of supporting the container with the rigid body of fluid permeable material during the transmitting of heat and fluid pressure through the rigid body of fluid permeable material and during the compacting of the metal powder to thereby effect compaction of the metal powder in the container to a configuration which at least closely approximates the desired configuration of the article.

12. A method as set forth in claim 11 wherein said step of enclosing the container with the rigid body of fluid permeable material is performed after performance of said steps of filling the container with metal powder and sealing the filled container.

13. A method of forming an article from metal powder, said method comprising the steps of providing a thin metal container having an interior cavity with a configuration corresponding to the configuration of the article, said step of providing a metal container including the steps of electroplating a thin layer of metal over a pattern and then removing the pattern from the layer of metal to form a container having sufficient structural strength to be self-supporting during filling of the container with metal powder and having insufficient structural strength to be self-supporting without deformation after the container has been filled with metal powder and heated to a temperature sufficient to promote diffusion bonding of the particles of metal powder in the container, filling the container with metal powder, sealing the filled container so that fluid pressing against the container cannot enter the cavity, enclosing at least a portion of the filled and sealed container with a rigid body of fluid permeable ceramic material having side surface areas disposed in engagement with outer side surfaces of the container, said step of enclosing the container with a rigid body of fluid permeable ceramic material being performed after said steps of filling and sealing the container and including the step of shaping the inside surface areas of the rigid body of fluid permeable material to have a configuration which corresponds to the configuration of at least portions of the outer side surfaces of the container, heating the container and metal powder in the container to a temperature sufficient to promote diffusion bonding of the particles of metal powder by transmitting heat through the rigid body of fluid permeable ceramic material to the container, compacting the heated metal powder in the container under the influence of the fluid pressure transmitted through the rigid body of fluid permeable ceramic material, said step of compacting the heated metal powder including the steps of providing space between portions of the outer side surfaces of the container and inner side surface areas of the rigid body fluid permeable ceramic material by moving said surface areas of the container into a spaced apart relationship with the inner side surface areas of the rigid body of fluid permeable ceramic material, said method further including the step of supporting the container with the rigid body of fluid permeable ceramic material during the transmitting of heat and fluid pressure through the rigid body of fluid permeable ceramic material and during the compacting of the metal powder to thereby effect compaction of the metal powder in the container to a configuration which at least closely approximates the desired configuration of the article.

14. A method of forming an article from metal powder by compacting the powder under heat and pressure comprising the steps of:

providing a self supporting pressure responsive, metal container of a predetermined shape having an interior cavity which is determinative of the final shape configuration of the article and having wall portions whose outer surfaces define an initial spatial boundary of the container, filling the cavity in the container with metal powder, sealing the filled container against the entry of a pressurizing fluid, enclosing a portion of the filled and sealed container with a rigid body of fluid permeable material having contoured wall portions that conform generally to the outer surfaces of the shaped metal container, transmitting heat and fluid pressure through the rigid body of fluid permeable material to the filled and sealed container, compacting the heated metal powder in the sealed container under the influence of the fluid pressure transmitted through the rigid body of fluid permeable material, said step of compacting the heated metal powder including the steps of providing space between portions of the outer surfaces of the container wall portions and the contoured wall portions of the rigid body of fluid permeable material by a controlled collapsing of container wall portions into spaced apart relationship with the rigid body of fluid permeable material and inducing stresses into the container tending to distort said predetermined shape beyond the initial spatial boundary, said method further including the step of maintaining the performed shape of the container while under the influence of stresses induced in the container during the compacting of the metal powder by selectively restricting movement of the portions of the container to within the spatial boundary and permitting a controlled collapse of the container to thereby effect compaction of the metal powder in the container to the predetermined shape configuration.

15. A method of forming an article from metal powder, said method comprising the steps of providing a metal container having an interior cavity with a configuration corresponding to the configuration of the article and having side walls with outer side surfaces which define an initial spatial boundary of the container, filling the cavity in the container with metal powder, sealing the filled container so that fluid pressing against the outer side surfaces of the container cannot enter the cavity, thereafter, enclosing at least a portion of the filled and sealed container with a rigid body of fluid permeable material having inner side surface areas disposed in engagement with outer side surfaces of the container, said step of enclosing the container with a rigid body of fluid permeable material includes the steps of providing a body of ceramic slurry, surrounding the filled and sealed container with the body of ceramic slurry, and hardening the body of ceramic slurry around the container, transmitting heat and fluid pressure through the rigid body of fluid permeable material to the container, compacting the heated metal powder in the container under the influence of the fluid pressure transmitted through the rigid body of fluid permeable material, said step of compacting the heated metal powder including the steps of providing space between portions of outer side surfaces of the container and inner side surface areas of the rigid body of fluid permeable material by moving surface areas of the container into a spaced apart relationship with the inner side surface areas of the rigid body of fluid permeable material and inducing in the container stresses tending to deflect the container to a configuration in which at least a portion of the container would be outside the initial spatial boundary of the container, said method further including the step of maintaining the container within the initial spatial boundary of the container against the influence of stresses induced in the container during the compacting of the metal powder by blocking movement of portions of the container out of the initial spatial boundary of the container with the rigid body of fluid permeable material to thereby effect compaction of the metal powder in the container to a configuration which at least closely approximates the desired configuration of the article.

16. A method as set forth in claim 15 wherein the step of providing a container includes providing an elongated container, said method further including increasing the axial length of the container without resistance from the rigid body of fluid permeable material during the step of transmitting heat to the container and decreasing the axial length of the container without resistance from the rigid body of fluid permeable material during said step of compacting the metal powder in the container.

17. A method as set forth in claim 15 wherein said step of enclosing the container with the rigid body of fluid permeable material includes the step of leaving one end portion of the container projecting outwardly from the rigid body of fluid permeable material.

18. A method as set forth in claim 15 wherein said step of providing an elongated metal container includes the step of providing a container having sufficient structural strength to be self-supporting during filling of the container and insufficient structural strength to be self-supporting without deformation during performance of said step of transmitting heat and fluid pressure to the container.

19. A method as set forth in claim 15 wherein said step of providing a container includes the steps of providing a pattern having a configuration which corresponds to the configuration of the article, electroplating a layer of metal over the pattern, building up different metal thicknesses over different portions of the pattern during said step of electroplating a layer of metal over the pattern, and removing the pattern from within the layer of metal to leave the container, said step of enclosing at least a portion of the container with a rigid body of fluid permeable material including the step of shaping inside surface areas of the rigid body of fluid permeable material to have a configuration which differs from the configuration of the pattern by an amount which is a function of the variations in the thickness of the metal built up over different portions of the pattern during said step of electroplating a layer of metal over the pattern.

20. A method as set forth in claim 15 wherein said step of providing space between portions of the side surfaces of the container and inner side surface areas of the rigid body of fluid permeable material includes providing space between opposite outer side surfaces of the container and inner side surfaces of the rigid body of fluid permeable material at a location along the container.

21. A method of forming an article from metal powder, said method comprising the steps of providing a metal container having an interior cavity with a configuration corresponding to the configuration of the article and having side walls with outer side surfaces which define an initial spatial boundary of the container, filling the cavity in the container with metal powder, sealing the filled container so that fluid pressing against the outer side surfaces of the container cannot enter the cavity, thereafter, enclosing at least a portion of the filled and sealed container with a rigid body of fluid permeable material having inner side surface areas disposed in engagement with outer side surfaces of the container, said step of enclosing the container with a rigid body of fluid permeable material includes the step of providing first and second rigid members formed of a fluid permeable material and placing the members in engagement with side surfaces of the filled and sealed container, transmitting heat and fluid pressure through the rigid body of fluid permeable material to the container, compacting the heated metal powder in the container under the influence of the fluid pressure transmitted through the rigid body of fluid permeable material, said step of compacting the heated metal powder including the steps of providing space between portions of outer side surfaces of the container and inner side surface areas of the rigid body of fluid permeable material by moving surface areas of the container into a spaced apart relationship with the inner side surface areas of the rigid body of fluid permeable material and inducing in the container stesses tending to deflect the container to a configuration in which at least a portion of the container would be outside the initial spatial boundary of the container, said method further including the step of maintaining the container within the initial spatial boundary of the container against the influence of stresses induced in the container during the compacting of the metal powder by blocking movement of portions of the container out of the initial spatial boundary of the container with the rigid body of fluid permeable material to thereby effect compaction of the metal powder in the container to a configuration which at least closely approximates the desired configuration of the article.

22. A method as set forth in claim 21 wherein the step of providing a container includes providing an elongated container, said method further including increasing the axial length of the container without resistance from the rigid body of fluid permeable material during said step of transmitting heat to the container and decreasing the axial length of the container without resistance from the rigid body of fluid permeable material during said step of compacting the metal powder in the container.

23. A method as set forth in claim 21 wherein said step of enclosing the container with the rigid body of fluid permeable material includes the step of leaving one end portion of the container projecting outwardly from the rigid body of fluid permeable material.

24. A method as set forth in claim 21 wherein said step of placing the rigid fluid permeable members in engagement with the side surfaces of the container includes the step of leaving an elongated gap between the members, said method further including the step of providing relative movement between the members to at least partially close the gap during said step of compacting the metal powder.

25. A method as set forth in claim 21 wherein said step of providing an elongated metal container includes the step of providing a container having sufficient structural strength to be self-supporting during filling of the container and insufficient structural strength to be self-supporting without deformation during performance of said step of transmitting heat and fluid pressure to the container.

26. A method as set forth in claim 21 wherein said step of providing a container includes the steps of providing a pattern having a configuration which corresponds to the configuration of the article, electroplating a layer of metal over the pattern, building up different metal thicknesses over different portions of the pattern during said step of electroplating a layer of metal over the pattern, and removing the pattern from within the layer of metal to leave the container, said step of enclosing at least a portion of the container with a rigid body of fluid permeable material including the step of shaping inside surface areas of the rigid body of fluid permeable material to have a configuration which differs from the configuration of the pattern by an amount which is a function of the variations in the thickness of the metal built up over different portions of the pattern during said step of electroplating a layer of metal over the pattern.

27. A method as set forth in claim 21 wherein said step of providing space between portions of the side surfaces of the container and inner side surface areas of the rigid body of fluid permeable material includes providing space between opposite outer side surfaces of the container and inner side surfaces of the rigid body of fluid permeable material at a location along the container.

28. A method of forming an article from metal powder, said method comprising the steps of providing a metal container having an interior cavity with a configuration corresponding to the configuration of the article and having side walls with outer side surfaces which define an initial spatial boundary of the container, filling the cavity in the container with metal powder, sealing the filled container so that fluid pressing against the outer side surfaces of the container cannot enter the cavity, thereafter, enclosing at least a portion of the filled and sealed container with a rigid body of fluid permeable material having inner side surface areas disposed in engagement with outer side surfaces of the container, said step of enclosing the container with a rigid body of fluid permeable material includes the steps of providing a body of ceramic slurry, repetitively dipping the filled and sealed container in the body of ceramic slurry to build up layers of ceramic slurry over the container, and hardening layers of the ceramic slurry built up over the container, transmitting heat and fluid pressure through the rigid body of fluid permeable material to the container, compacting the heated metal powder in the container under the influence of the fluid pressure transmitted through the rigid body of fluid permeable material, said step of compacting the heated metal powder including the steps of providing space between portions of outer side surfaces of the container and inner side surface areas of the rigid body of fluid permeable material by moving surface areas of the container into a spaced apart relationship with the inner side surface areas of the rigid body of fluid permeable material and inducing in the container stresses tending to deflect the container to a configuration in which at least a portion of the container would be outside the initial spatial boundary of the container, said method further including the step of maintaining the container within the initial spatial boundary of the container against the influence of stresses induced in the container during the compacting of the metal powder by blocking movement of portions of the container out of the initial spatial boundary of the container with the rigid body of fluid permeable material to thereby effect compaction of the metal powder in the container to a configuration which at least closely approximates the desired configuration of the article.

29. A method as set forth in claim 28 wherein said step of repetitively dipping the container in the body of ceramic slurry includes the step of keeping one end portion of the container out of the body of ceramic slurry.

30. A method as set forth in claim 28 wherein said step of providing an elongated metal container includes the step of providing a container having sufficient structural strength to be self-supporting during filling of the container and insufficient structural strength to be self-supporting without deformation during performance of said step of transmitting heat and fluid pressure to the container.

31. A method of forming an article from metal powder, said method comprising the steps of providing a thin metal container having an interior cavity with a configuration corresponding to the configuration of the article and having side walls with outer side surfaces having a configuration which is different than the configuration of the article, said step of providing a metal container including the steps of electroplating a thin layer of metal over a pattern and then removing the pattern from the layer of metal to form a container having sufficient structural strength to be self-supporting during filling of the container with metal powder and having insufficient structural strength to be self-supporting without deformation after the container has been filled with metal powder and heated to a temperature sufficient to promote diffusion bonding of the particles of metal powder in the container, filling the container with metal powder, sealing the filled container so that fluid pressing against the container cannot enter the cavity, enclosing at least a portion of the container with a rigid body of fluid permeable material having side surface areas disposed in engagement with outer side surfaces of the container, said step of enclosing the container with a rigid body of fluid permeable material including the steps of providing a body of ceramic slurry, enclosing at least a portion of the container with the body of ceramic slurry, hardening the body of ceramic slurry around the container to shape the inside surface areas of the rigid body of fluid permeable material to have a configuration which corresponds to the configuration of the outer side surfaces of the container and differs from the configuration of the article, heating the container and metal powder in the container to a temperature sufficient to promote diffusion bonding of the particles of metal powder by transmitting heat through the rigid body of fluid permeable material to the container, compacting the heated metal powder in the container under the influence of the fluid pressure transmitted through the rigid body of fluid permeable material, said step of compacting the heated metal powder including the steps of providing space between portions of the outer side surfaces of the container and inner side surface areas of the rigid body of fluid permeable material by moving side surface areas of the container into a spaced apart relationship with the inner side surface areas of the rigid body of fluid permeable material, said method further including the step of supporting the container with the rigid body of fluid permeable material during the transmitting of heat and fluid pressure through the rigid body of fluid permeable material and during the compacting of the metal powder to thereby effect compaction of the metal powder in the container to a configuration which at least closely approximates the desired configuration of the article.

32. A method as set forth in claim 31 wherein said step of enclosing the container with the body of ceramic slurry is performed after performance of said steps of filling the container with metal powder and sealing the filled container.

33. A method of forming an article from metal powder, said method comprising the steps of providing a thin metal container having an interior cavity with a configuration corresponding to the configuration of the article and having side walls with outer side surfaces having a configuration which is different than the configuration of the article, said step of providing a metal container including the steps of electroplating a thin layer of metal over a pattern and then removing the pattern from the layer of metal to form a container having sufficient structural strength to be self-supporting during filling of the container with metal powder and having insufficient structural strength to be self-supporting without deformation after the container has been filled with metal powder and heated to a temperature sufficient to promote diffusion bonding of the particles of metal powder in the container, filling the container with metal powder, sealing the filled container so that fluid pressing against the container cannot enter the cavity, enclosing at least a portion of the container with a rigid body of fluid permeable material having side surface areas disposed in engagement with outer side surfaces of the container, said step of enclosing the container with a rigid body of fluid permeable material including the steps of providing a body of ceramic slurry, repetitively dipping at least a portion of the container in the body of ceramic slurry, and hardening layers of the ceramic slurry built up over the outside of the container during performance of said step of repetitively dipping the container in the body of ceramic slurry to shape the inside surface areas of the rigid body of fluid permeable material to have a configuration which corresponds to the configuration of the outer side surfaces of the container and differs from the configuration of the article, heating the container and metal powder in the container to a temperature sufficient to promote diffusion bonding of the particles of metal powder by transmitting heat through the rigid body of fluid permeable material to the container, compacting the heated metal powder in the container under the influence of the fluid pressure transmitted through the rigid body of fluid permeable material, said step of compacting the heated metal powder including the steps of providing space between portions of the outer side surfaces of the container and inner side surface areas of the rigid body of fluid permeable material by moving side surface areas of the container into a spaced apart relationship with the inner side surface areas of the rigid body of fluid permeable material, said method further including the step of supporting the container with the rigid body of fluid permeable material during the transmitting of heat and fluid pressure through the rigid body of fluid permeable material and during the compacting of the metal powder to thereby effect compaction of the metal powder in the container to a configuration which at least closely approximates the desired configuration of the article.

34. A method as set forth in claim 33 wherein said step of repetitively dipping the container in the body of ceramic slurry is performed after performance of said steps of filling the container with metal powder and sealing the filled container.

35. A method of forming an article from metal powder, said method comprising the steps of providing a thin metal container having an interior cavity with a configuration corresponding to the configuration of the article and having side walls with outer side surfaces having a configuration which is different than the configuration of the article, said step of providing a metal container including the steps of electroplating a thin layer of metal over a pattern and then removing the pattern from the layer of metal to form a container having sufficient structural strength to be self-supporting during filling of the container with metal powder and having insufficient structural strength to be self-supporting without deformation after the container has been filled with metal powder and heated to a temperature sufficient to promote diffusion bonding of the particles of metal powder in the container, filling the container with metal powder, sealing the filled container so that fluid pressing against the container cannot enter the cavity, enclosing at least a portion of the container with a rigid body of fluid permeable material having side surface areas disposed in engagement with outer side surfaces of the container, said step of enclosing the container with a rigid body of fluid permeable material including the steps of providing first and second members formed of a fluid permeable material, shaping surface areas of first and second members to have a configuration which corresponds to the configuration of the outer side surfaces of the container and differs from the configuration of the article, and placing the first and second members in engagement with said surfaces of the container, said method further including the steps of heating the container and metal powder in the container to a temperature sufficient to promote diffusion bonding of the particles of metal powder by transmitting heat through the rigid body of fluid permeable material to the container, compacting the heated metal powder in the container under the influence of the fluid pressure transmitted through the rigid body of fluid permeable material, said step of compacting the heated metal powder including the steps of providing space between portions of the outer side surfaces of the container and inner side surface areas of the rigid body of fluid permeable material by moving side surface areas of the container into a spaced apart relationship with the inner side surface areas of the rigid body of fluid permeable material, said method further including the step of supporting the container with the rigid body of fluid permeable material during the transmitting of heat and fluid pressure through the rigid body of fluid permeable material and during the compacting of the metal powder to thereby effect compaction of the metal powder in the container to a configuration which at least closely approximates the desired configuration of the article.

36. A method of forming an article from metal powder, said method comprising the steps of providing a thin metal container having an interior cavity with a configuration corresponding to the configuration of the article and having side walls with outer side surfaces having a configuration which is different than the configuration of the article, said step of providing a metal container including the steps of electroplating a thin layer of metal over a pattern and then removing the pattern from the layer of metal to form a container having sufficient structural strength to be self-supporting during filling of the container with metal powder and having insufficient structural strength to be self-supporting without deformation after the container has been filled with metal powder and heated to a temperature sufficient to promote diffusion bonding of the particles of metal powder in the container, said step of removing the pattern from the layer of metal includes the step of conducting the pattern material through a first opening in the layer of metal, filling the container with metal powder, said step of filling the container including the step of conducting a flow of metal powder into the container through a second opening, sealing the filled container so that fluid pressing against the container cannot enter the cavity, said step of sealing the container including the step of sealing the first opening prior to filling of the container, said step of sealing the container further including the step of sealing the second opening, enclosing at least a portion of the container with a rigid body of fluid permeable material having side surface areas disposed in engagement with outer side surfaces of the container, said step of enclosing the container with a rigid body of fluid permeable material including the step of shaping the inside surface areas of the rigid body of fluid permeable material to have a configuration which corresponds to the configuration of the outer side surfaces of the container and differs from the configuration of the article, heating the container and metal powder in the container to a temperature sufficient to promote diffusion bonding of the particles of metal powder by transmitting heat through the rigid body of fluid permeable material to the container, compacting the heated metal powder in the container under the influence of the fluid pressure transmitted through the rigid body of fluid permeable material, said step of compacting the heated metal powder including the steps of providing space between portions of the outer side surfaces of the container and inner side surface areas of the rigid body of fluid permeable material by moving side surface areas of the container into a spaced apart relationship with the inner side surface areas of the rigid body of fluid permeable material, said method further including the step of supporting the container with the rigid body of fluid permeable material during the transmitting of heat and fluid pressure through the rigid body of fluid permeable material and during the compacting of the metal powder to thereby effect compaction of the metal powder in the container to a configuration which at least closely approximates the desired configuration of the article.

37. A method as set forth in claim 36 wherein said step of enclosing the container with a rigid body of fluid permeable material includes the steps of providing a body of ceramic slurry, enclosing at least a portion of the container with the body of ceramic slurry, and hardening the body of ceramic slurry around the container.

38. A method as set forth in claim 37 wherein said step of enclosing the container with the body of ceramic slurry is performed after performance of said steps of filling the container with metal powder and sealing the filled container.

39. A method as set forth in claim 36 wherein said step of enclosing the container with a rigid body of fluid permeable material includes the steps of providing a body of ceramic slurry, repetitively dipping at least a portion of the container in the body of ceramic slurry, and hardening layers of the ceramic slurry built up over the outside of the container during performance of said step of repetitively dipping the container in the body of ceramic slurry.

40. A method as set forth in claim 39 wherein said step of repetitively dipping the container in the body of ceramic slurry is performed after performance of said steps of filling the container with metal powder and sealing the filled container.

41. A method as set forth in claim 36 wherein said step of enclosing the container with a rigid body of fluid permeable material includes the step of providing first and second members formed of a fluid permeable material and placing the members in engagement with side surfaces of the container.

42. A method of forming an article from metal powder, said method comprising the steps of providing a metal container having sufficient structural strength to be self-supporting during filling of the container with metal powder and having insufficient structural strength to be self-supporting without deformation after the container has been filled with metal powder and heated to a temperature sufficient to promote diffusion bonding of the particles of metal powder in the container, filling the container with metal powder, sealing the filled container so that fluid pressing against the container cannot enter the cavity, thereafter, enclosing at least a portion of the container with a rigid body of fluid permeable material having side surface areas disposed in engagement with outer side surfaces of the container, heating the container and metal powder in the container to a temperature sufficient to promote diffusion bonding of the particles of metal powder by transmitting heat through the rigid body of fluid permeable material to the container, compacting the heated metal powder in the container under the influence of the fluid pressure by transmitting fluid pressure through the rigid body of fluid permeable material while maintaining intact the structure of the rigid body of fluid permeable material, and supporting the container with the rigid body of fluid permeable material during the transmitting of heat and fluid pressure through the rigid body of fluid permeable material and during the compacting of the metal powder.

43. A method as set forth in claim 42 wherein said step of enclosing the container with a rigid body of fluid permeable material includes the steps of providing a body of ceramic slurry, enclosing at least a portion of the container with the body of ceramic slurry, and hardening the body of ceramic slurry around the container.

44. A method as set forth in claim 42 wherein said step of enclosing the container with a rigid body of fluid permeable material includes the steps of providing a body of ceramic slurry, repetitively dipping at least a portion of the container in the body of ceramic slurry, and hardening layers of the ceramic slurry built up over the outside of the container during performance of said step of repetitively dipping the container in the body of ceramic slurry.

45. A method as set forth in claim 42 wherein said step of enclosing the container with a rigid body of fluid permeable material includes the step of providing first and second members formed of a fluid permeable material and placing the members in engagement with side surfaces of the container.

46. A method as set forth in claim 42 wherein said step of compacting the heated metal powder includes providing space between portions of the outer side surfaces of the container and inner side surface areas of the rigid body of fluid permeable material by moving side surface areas of the container into a spaced apart relationship with the inner side surface areas of the rigid body of fluid permeable material.

47. A method as set forth in claim 42 wherein said step of enclosing at least a portion of the container with a rigid body of fluid permeable material includes providing a plurality of rigid members formed of fluid permeable material and placing the members in engagement with outer side surface areas of the container, said step of placing members in engagement with outer side surface areas of the containers includes leaving a space between the members, said method further including the step of reducing the size of the space between the members during the compacting of the metal powder.

48. A method as set forth in claim 42 wherein said step of providing a metal container includes the steps of electroplating a thin layer of metal over a pattern and then removing the pattern from the layer of metal to form the container.

49. A method as set forth in claim 42 wherein said step of enclosing the container with a rigid body of fluid permeable material includes the step of leaving one end portion of the container projecting outwardly from the rigid body of fluid permeable material to tend to minimize resistance to thermal expansion of the container during performance of said step of heating the container and to tend to minimize resistance to contraction of the container during said step of compacting the metal powder.

50. A method as set forth in claim 42 wherein the article to be formed from metal powder includes an airfoil having concave and convex side surfaces, said step of providing a container includes providing a container having concave and convex surface areas with configurations which are a function of the configurations of the side surfaces of the airfoil, said step of enclosing the container with a rigid body of fluid permeable material includes providing a first block of rigid fluid permeable material having a convex side surface area with a configuration which is a function of the configuration of the concave side surface of the airfoil, providing a second block of rigid fluid permeable material having a concave side surface area with a configuration which is a function of the configuration of the convex side surface of the airfoil, placing the first block in engagement with the concave surface area of the container, and placing the second block in engagement with the convex surface area of the container.

51. A method as set forth in claim 50 wherein said steps of placing the first and second blocks in engagement with sides of the container includes leaving a gap between edge portions of the first and second blocks, said step of compacting the metal powder including the steps of pressing the first and second blocks against opposite sides of the container and providing relative movement between the first and second blocks to at least partially close the gap between edge portions of the first and second blocks.

52. A method as set forth in claim 50 further including the steps of placing a weight on one of said blocks and moving the one block toward the other block under the influence of the weight after having performed said step of heating the container.

53. A method as set forth in claim 50 further including pressing the first and second blocks against opposite sides of the container by providing a variable volume chamber and pressing the blocks against opposite sides of the container under the influence of fluid pressure in the variable volume chamber.

54. A method as set forth in claim 42 wherein said step of enclosing at least a portion of the container with a rigid body of fluid permeable material includes providing a plurality of rigid members formed of fluid permeable material and placing the material in engagement with outer side surface areas of the container.

55. A method as set forth in claim 54 wherein said step of placing the members in engagement with side surface areas of the container includes leaving a space between the members, said step of compacting the metal powder including the steps of pressing the members against the container and providing relative movement between the members to at least partially close the space between the members.

56. A method as set forth in claim 54 further including the steps of placing a weight on one of the members, moving at least one of the members toward another member under the influence of the weight after having performed said step of heating the container.

57. A method as set forth in claim 54 further including the steps of providing a variable volume chamber and pressing the members against opposite sides of the container under the influence of fluid pressure in the variable volume chamber.

58. A method as set forth in claim 54 further including the steps of pressing the members against the container with a clamping force which is applied against the members by a metal clamping element, said step of heating the container including heating the metal clamping element and thermally expanding the metal clamping element in a manner which tends to decrease the clamping force applied against the members, said method further including compensating for the thermal expansion of the clamping element to maintain clamping force against the members.

59. A method as set forth in claim 58 wherein said step of compensating for the thermal expansion of the clamping element includes thermally expanding a compensating element which is connected with the clamping element and has a coefficient of thermal expansion which is greater than the coefficient of thermal expansion of the clamping element.

60. A method as set forth in claim 59 wherein said step of thermally expanding a compensating element includes the steps of expanding the compensating element to an extent sufficient to increase the clamping force against the members.

61. An apparatus for use in forming an article of metal powder, said apparatus comprising a metal container having sufficient structural strength to be self-supporting during filling of the container with metal powder and having insufficient structural strength to be self-supporting without sagging after the container has been filled with metal powder and heated to a temperature sufficient to promote diffusion bonding of the particles of metal powder in the container, means for heating said container of metal powder to a temperature sufficient to promote diffusion bonding of the particles of metal powder in said container, a plurality of rigid members formed of fluid permeable material, said rigid members of fluid permeable material having inner side surfaces for engaging outer side surface areas of said container with a space between said members, and means for pressing said rigid members of fluid permeable material against outer side surface areas of the container during the application of heat and fluid pressure to said container, said means for pressing said rigid members against the outer side surface areas of said container including means for decreasing the space between said members during the application of heat and fluid pressure to said container.

62. An apparatus as set forth in claim 61 wherein said means for pressing said rigid members against the outer side surface areas of said container includes a first clamp element having a first coefficient of thermal expansion and a second clamp element having a second coefficient of thermal expansion which is different than said first coefficient of thermal expansion, said first clamp element including means for urging said second clamp element against at least one of said rigid members during heating and thermal expansion of said second clamp element.

63. An apparatus as set forth in claim 61 wherein said means for pressing said rigid members against the outer side surface areas of said container includes a piston and cylinder assembly.

64. An apparatus as set forth in claim 61 wherein said means for pressing said rigid members against the outer side surface areas of said container includes a piston and cylinder assembly which is operable to apply force against at least one of said members and to move one of said members relative to another one of said members.

65. A method of forming an article from metal powder, said method comprising the steps of providing a thin metal container having an interior cavity with a configuration corresponding to the configuration of the article, said step of providing a metal container including the steps of forming a metal container having sufficient structural strength to be self-supporting during filling of the container with metal powder and having insufficient structural strength to be self-supporting without deformation after the container has been filled with metal powder and heated to a temperature sufficient to cause diffusion bonding of the particles of metal powder in the container, filling the container with metal powder, sealing the filled container so that fluid pressing against the container cannot enter the cavity, enclosing at least a portion of the filled and sealed container with a rigid body of fluid permeable material, said step of enclosing the container with a rigid body of fluid permeable material including providing a first block of rigid fluid permeable material having a side surface area with a configuration which is a function of the desired configuration of a first side of the article, providing a second block of rigid fluid permeable material having a side surface area with a configuration which is a function of the desired configuration of a second side of the article, placing the side surface area on the first block in engagement with one side of the container, and placing the side surface area on the second block in engagement with a side of the container opposite from the one side, heating the container and the metal powder in the container to a temperature sufficient to cause diffusion bonding of the metal powder in the container by transmitting heat through the rigid blocks of fluid permeable material to the container, compacting the metal powder in the container under the influence of the fluid pressure transmitted through the rigid body of fluid permeable material, and supporting the container with the first and second blocks during the transmitting of heat and fluid pressure through the rigid body of fluid permeable material and during the compacting of the metal powder to thereby effect compaction of the metal powder in the container to a configuration which at least closely approximates the desired configuration of the article.

66. A method as set forth in claim 65 wherein said step of providing a metal container includes the steps of electroplating a thin layer of metal over a pattern and then removing the pattern from the layer of metal to form the container.

67. A method as set forth in claim 65 wherein said steps of placing the side surface areas of the first and second blocks in engagement with the container includes the step of leaving one end portion of the container projecting outwardly from end surfaces of the blocks to tend to minimize resistance to thermal expansion of the container during performance of said step of heating the container and to tend to minimize resistance to contraction of the container during said step of compacting the metal powder in the container.

68. A method as set forth in claim 65 wherein the article to be formed from metal powder includes an airfoil having concave and convex side surfaces, said step of providing a first block of rigid fluid permeable material includes the step of providing a block having a convex side surface area with a configuration which is a function of the configuration of the concave side surface of the airfoil, said step of providing a second block of rigid fluid permeable material includes the step of providing a block having a concave side surface area with a configuration which is a function of the configuration of the convex side surface of the airfoil.

69. A method as set forth in claim 65 wherein said step of placing the side surface area on the second block in engagement with a side of the container opposite from the one side includes leaving a gap between edge portions of the first and second blocks, said step of compacting the metal powder including the steps of pressing the first and second blocks against opposite sides of the container and providing relative movement between the first and second blocks to at least partially close the gap between edge portions of the first and second blocks.

70. A method as set forth in claim 69 wherein said step of placing the side surface areas on the first and second blocks in engagement with the container includes the step of placing a first portion of the side surface area on one of the blocks in engagement with one of the sides of the container and leaving space between a second portion of the side surface area of the one block and the container, said step of providing relative movement between the first and second blocks to at least partially close the gap includes decreasing the space between the second portion of the side surface area of the one block and the container.

71. A method as set forth in claim 69 wherein said steps of placing the side surface areas on the first and second blocks in engagement with sides of the container includes leaving a gap which extends completely around the container, said step of providing relative movement between the blocks to at least partially close the gap includes bringing the edge portions of the blocks into engagement completely around the container.

72. A method as set forth in claim 69 wherein said step of providing a metal container includes the step of providing a metal container having a concave first side surface area with a curvature which is different than the curvature of a convex side surface area of the first block of rigid fluid permeable material and a convex second side surface area with a curvature which is different than the curvature of a concave side surface area of the second block of rigid fluid permeable material, said steps of placing the side surface areas on the first and second blocks in engagement with the container includes the steps of placing the concave first side surface area of the container and the convex side surface area of the first block in engagement and placing the convex second side surface area of the container and the concave side surface area of the second block in engagement, said steps of pressing the first and second blocks against opposite sides of the container and providing relative movement between the first and second blocks including changing the curvature of the concave first side surface area of the container to more closely correspond to the curvature of the convex side surface area of the first block and changing the curvature of the convex second side surface area of the container to more closely correspond to the curvature of the concave side surface area of the second block.

73. A method as set forth in claim 69 wherein said step of pressing the first and second blocks against opposite sides of the container includes placing a weight on one of said blocks, said step of providing relative movement between the first and second blocks includes the step of moving said one block toward the other block under the influence of the weight after having performed said step of heating the container.

74. A method as set forth in claim 69 wherein said step of pressing the first and second blocks against opposite sides of the container includes providing a variable volume chamber and pressing the blocks against opposite sides of the container under the influence of fluid pressure in the variable volume chamber, said step of providing relative movement between the first and second blocks including the step of increasing the size of the variable volume chamber.

75. A method of forming an article from metal powder, said method comprising the steps of providing a metal container having an interior cavity with a configuration corresponding to the configuration of the article, filling the container with metal powder, sealing the filled container so that fluid pressing against the container cannot enter the cavity, enclosing at least a portion of the filled and sealed container with a rigid body of fluid permeable material, said step of enclosing the container with a rigid body of fluid permeable material including providing a first block of rigid fluid permeable material having a side surface area with a configuration which is a function of the desired configuration of a first side of the article, providing a second block of rigid fluid permeable material having a side surface area with configuration which is a function of the desired configuration of a second side of the article, placing the side surface area on the first block in engagement with one side of the container, and placing the side surface area on the second block in engagement with a side of the container opposite from the one side, urging the first and second blocks toward each other with a clamping force which is applied against the blocks by a metal clamping element, thereafter, heating the first and second blocks, clamping element, container and metal powder in the container to a temperature sufficient to cause diffusion bonding of the metal powder in the container by transmitting heat through the first and second blocks to the container, thermally expanding the metal clamping element in a manner which tends to decrease the clamping force applied against the first and second blocks during performance of said heating step, compacting the metal powder in the container under the influence of the fluid pressure transmitted through the first and second blocks, and supporting the container with the first and second blocks during the transmitting of heat and fluid pressure through the first and second blocks and during the compacting of the metal powder to thereby effect compaction of the metal powder in the container to a configuration which at least closely approximates the desired configuration of the article, said step of supporting the container with the first and second blocks includes compensating for the thermal expansion of the clamping element to maintain a clamping force against the first and second blocks by thermally expanding a compensating element which is connected with the clamping element and has a coefficient of thermal expansion which is greater than the coefficient of thermal expansion of the clamping element, said step of thermally expanding the compensating element includes heating the compensating element along with the clamping element during performance of said heating step and increasing the size of a unit dimension of the compensating element by a greater amount than the size of a unit dimension of the clamping element during performance of said heating step.

76. A method as set forth in claim 75 wherein said step of providing a metal container includes the steps of electroplating a thin layer of metal over a pattern and then removing the pattern from the layer of metal to form the container.

77. A method as set forth in claim 75 wherein said steps of placing the side surface areas of the first and second blocks in engagement with the container includes the step of leaving one end portion of the container projecting outwardly from end surfaces of the blocks to tend to minimize resistance to thermal expansion of the container during performance of said step of heating the container and to tend to minimize resistance to contraction of the container during said step of compacting the metal powder in the container.

78. A method as set forth in claim 75 wherein the article to be formed from metal powder includes an airfoil having concave and convex side surfaces, said step of providing a first block of rigid fluid permeable material includes the step of providing a block having a convex side surface area with a configuration which is a function of the configuration of the concave side surface of the airfoil, said step of providing a second block of rigid fluid permeable material includes the step of providing a block having a concave side surface area with a configuration which is a function of the configuration of the convex side surface of the airfoil.

79. A method as set forth in claim 75 wherein said step of placing the side surface area on the second block in engagement with a side of the container opposite from the one side includes leaving a gap between edge portions of the first and second blocks, said step of compacting the metal powder including the steps of pressing the first and second blocks against opposite sides of the container and providing relative movement between the first and second blocks to at least partially close the gap between edge portions of the first and second blocks.

80. A method as set forth in claim 79 wherein said step of placing the side surface areas on the first and second blocks in engagement with the container includes the step of placing a first portion of the side surface area on one of the blocks in engagement with one of the sides of the container and leaving space between a second portion of the side surface area of the one block and the container, said step of providing relative movement between the first and second blocks to at least partially close the gap includes decreasing the space between the second portion of the side surface area of the one block and the container.

81. A method as set forth in claim 79 wherein said steps of placing the side surface areas on the first and second blocks in engagement with sides of the container includes leaving a gap which extends completely around the container, said step of providing relative movement between the blocks to at least partially close the gap includes bringing the edge portions of the blocks into engagement completely around the container.

82. A method as set forth in claim 79 wherein said step of providing a metal container includes the step of providing a metal container having a concave first side surface area with a curvature which is different than the curvature of a convex side surface area of the first block of rigid fluid permeable material and a convex second side surface area with a curvature which is different than the curvature of a concave side surface area of the second block of rigid fluid permeable material, said steps of placing the side surface areas on the first and second blocks in engagement with the container includes the steps of placing the concave first side surface area of the container and the convex side surface area of the first block in engagement and placing the convex second side surface area of the container and the concave side surface area of the second block in engagement, said steps of pressing the first and second blocks against opposite sides of the container and providing relative movement between the first and second blocks including changing the curvature of the concave first side surface area of the container to more closely correspond to the curvature of the convex side surface area of the first block and changing the curvature of the convex second side surface area of the container to more closely correspond to the curvature of the concave side surface area of the second block.

83. A method as set forth in claim 75 wherein said step of urging the first and second blocks toward each other with a clamping force includes the step of wrapping a wire having a first coefficient of thermal expansion around the first and second blocks, said step of compensating for thermal expansion of the clamping element includes providing a compensating element having a second coefficient of thermal expansion which is greater than the first coefficient of thermal expansion between the wire and the one of the first and second blocks.

84. A method as set forth in claim 75 wherein said step of maintaining a clamping force against the first and second blocks by expanding a compensating element includes the steps of expanding the compensating element to an extent sufficient to increase the clamping force against the first and second blocks.

* * * * *